US006209549B1

(12) United States Patent
Lunde

(10) Patent No.: US 6,209,549 B1
(45) Date of Patent: Apr. 3, 2001

(54) HAIR ROOT VOLUMIZING CLIP

(76) Inventor: Sandra Lunde, 2720 Ubben Ave., Ellsworth, IA (US) 50075

( * ) Notice: Subject to any disclaimer, the term of this patent is extended or adjusted under 35 U.S.C. 154(b) by 0 days.

(21) Appl. No.: 09/422,395

(22) Filed: Oct. 21, 1999

(51) Int. Cl.[7] ..... A45D 7/04; A45D 24/00; A45D 8/20

(52) U.S. Cl. ..... 132/207; 132/277; 132/200

(58) Field of Search ..... 132/207, 277, 132/212, 208, 276, 200, 203, 202

(56) References Cited

U.S. PATENT DOCUMENTS

| | | | | |
|---|---|---|---|---|
| 4,494,557 | * | 1/1985 | Nagel | 132/207 |
| 5,080,116 | * | 1/1992 | Ballard | 132/207 |
| 5,156,172 | * | 10/1992 | Tancredi | 132/207 |
| 5,207,235 | * | 5/1993 | Muller et al. | 132/207 |
| 5,706,839 | * | 1/1998 | Patti | 132/277 |
| 5,813,418 | * | 10/1998 | Pillards | 132/201 |
| 5,829,455 | * | 11/1998 | Bauer | 132/222 |
| 5,893,374 | * | 4/1999 | Decareau | 132/207 |
| 5,996,593 | * | 12/1999 | Horman | 132/278 |

* cited by examiner

*Primary Examiner*—John J. Wilson
*Assistant Examiner*—Robyn Kieu Doan
(74) *Attorney, Agent, or Firm*—Zarley, McKee, Thomte, Voorhees & Sease

(57) ABSTRACT

A method of increasing hair volume includes applying a hair clip to the roots of the hair. A chemical solution is applied to at least part of the hair that is in the clip. After the first step of the chemical processing is complete, the hair is rinsed, with the hair clip still in place. Then the second step is applied. A hair clip to increase hair volume includes two arms that are pivotally connected. The arms have interior faces that oppose each other. At least one of the interior faces has texture to apply tension to the hair root. At least one of the arms has openings to allow the hair to be rinsed while the clip is still in place. A second method of increasing hair volume comprises applying hair spray to hair roots and applying a clip to the roots. The clip is left in place until the hair spray is dry. The clip can be applied before the hair spray. The clip can also be used on wet hair with gels, mousses, hairspray, etc. The clip is clipped into place and the hair may be air dried or dried under a dryer. The clip may also be used to straighten curly, unruly hair.

11 Claims, 2 Drawing Sheets

HAIR ROOT VOLUMIZING CLIP

BACKGROUND OF THE INVENTION

1. Field of the Invention

The present invention relates to hair treatment. More specifically, the present invention relates to a method of increasing hair volume and texture, and to a clip that can be used to increase hair volume and texture.

2. Problems in the Art

A wide variety of devices are known in the art for use in treating hair. Various types of hair clamps, curling irons, and hot rollers have been used to control how the hair looks. While some of these devices function adequately in keeping hair in place and helping the hair maintain a desired shape or curl, there is no known method or device which sufficiently increases hair volume and texture at the root only without also adding curl.

Many people desire to have hair that has a full volume and texture. Thick hair with a lot of volume helps give the appearance of youth and health. However, many people are not fortunate enough to have hair that is naturally full of volume and texture. There is a need for a method and device that adds volume and texture to hair.

Therefore, it is a primary objective of the present invention to provide a device and method which can be used to increase hair volume and texture.

It is a further object of the present invention to provide a hair clip which can be applied prior to applying perming solution or other types of chemical hair treatments.

A further object of the present invention is to provide a hair clip which places sufficient tension on the hair root to lift it up from the scalp.

A further object of the present invention is to provide a hair clip which can be left in place while the hair is being rinsed and while chemical treatments are being applied to the hair.

These, as well as other objects and features of the present invention, will become apparent from the following detailed description and claims in conjunction with the accompanying drawings.

SUMMARY OF THE INVENTION

A method of increasing hair volume includes applying a hair clip to the roots of the hair. A chemical solution is applied to at least part of the hair that is in the clip. After chemical processing is complete, the hair is rinsed, with the hair clip still in place. Then the second chemical step is applied.

A hair clip to increase hair volume includes two arms that are pivotally connected. The arms have interior faces that oppose each other. At least one of the interior faces has texture to apply tension to the hair root. At least one of the arms has openings to allow the hair to be rinsed while the clip is still in place.

A second method of increasing hair volume comprises applying hair spray to hair roots and applying a clip to the roots. The clip is left in place until the hair spray is dry. The clip can be applied before the hair spray. The clip may be used on wet or dry hair and with or without heat.

DETAILED DESCRIPTION OF AN EXEMPLARY EMBODIMENT

Figure 2:
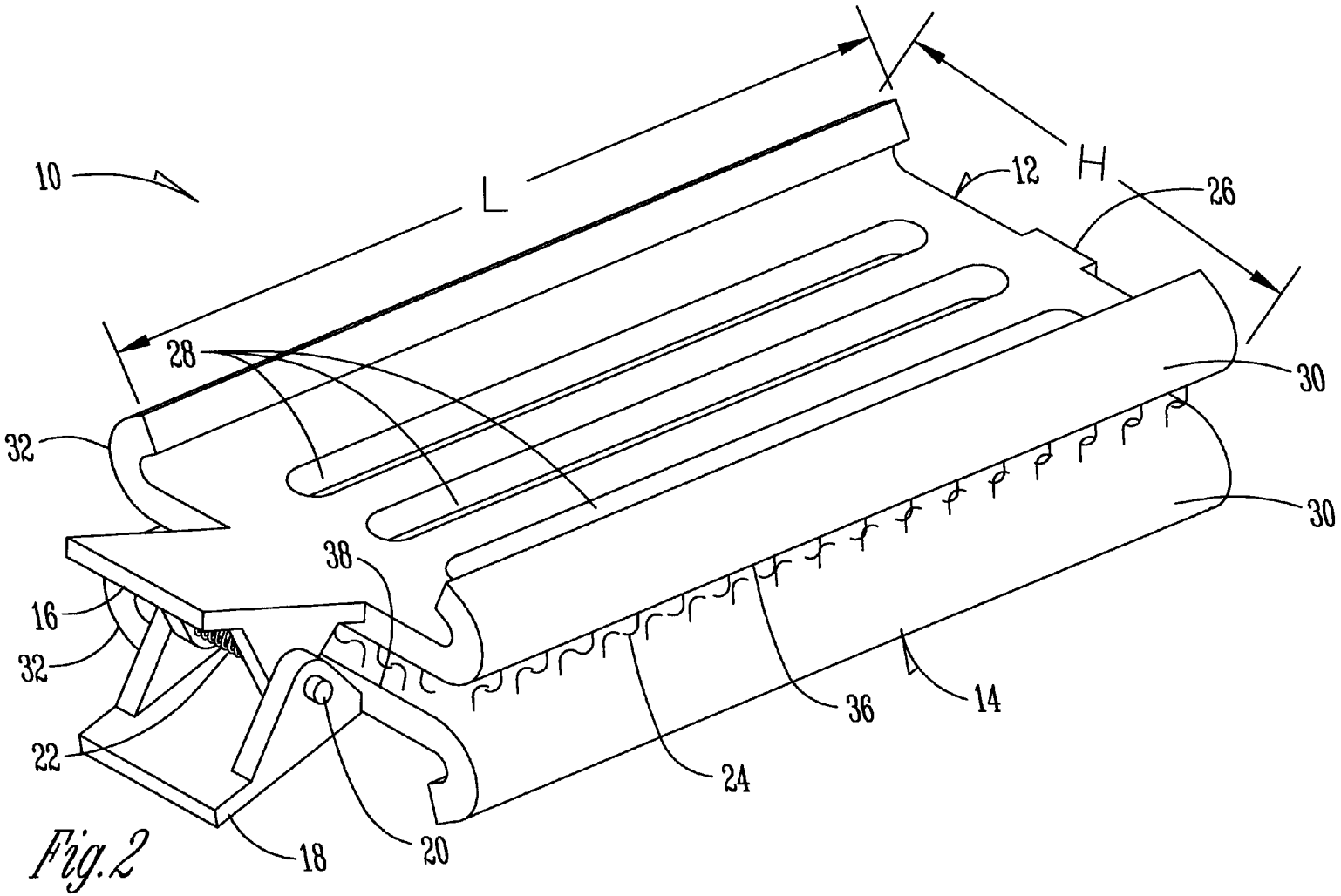
FIG. 2 is a perspective view of the hair clip of FIG. 1.

FIG. 2 shows a perspective view of a hair root volumizing clip 10. The hair clip 10 includes two arms 12, 14. The arms 12, 14 are preferably made of plastic, but other materials could be used as well. Each arm 12, 14 has a tab 16, 18. A pivot rod 20 connects the tabs 16, 18. A torsional spring 22 biases the hair clip 10 into a closed position. The tabs 16, 18 are squeezed together to open the hair clip 10.

Each arm 12, 14 has an interior face 36, 38. Hook fibers or fasteners 24 (also known as VELCRO hook fibers or fasteners) are attached to each interior face 36, 38. The hook fibers 24 help apply tension to the hair 34. The tension produced by the clip 10 and the hook fibers 24 results in better lifting of the root 40 of the hair 34 than prior art techniques. Of course, materials other than hook fibers 24 could be used. For example, the interior faces 36, 38 could be scuffed such that they had a sandpaper like texture.

The hair clip 10 has a number of grooves 28. The grooves 28 allow the hair 34 to be rinsed while the clip is still in place. A tension clasp 26 helps keep the hair clip 10 in a shut position. Rather than a tension clasp, other types of fasteners could be utilized to keep the hair clip 10 closed.

Figure 3:
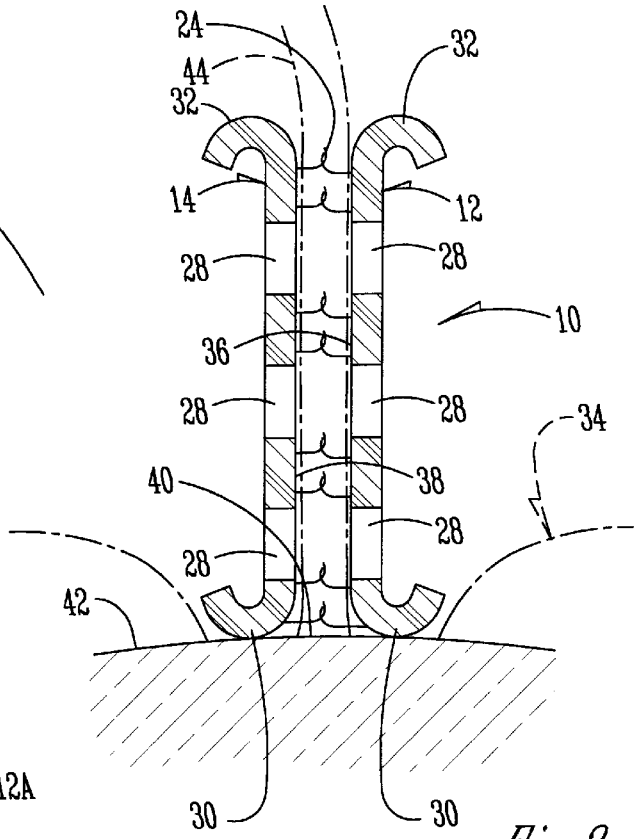
FIG. 3 is a cross-sectional view taken along line 3—3 of FIG. 1.

The hair clip 10 has a length, L, and a height, H. Preferably, the length, L, is greater than the height, H. This feature adds stability to the clip 10, helping to keep the clip 10 in the proper place. Preferably, the top 32 and bottom 30 ends of the clip 10 are wider than the middle of the clip 10. This feature also adds stability to the clip and can best be seen on the hair clip 10 in FIG. 3. Optionally, the bottom 30 of the hair clip 10 could have a concave shape. The concave shape would help fit the hair clip 10 onto the scalp 42.

Figure 1:
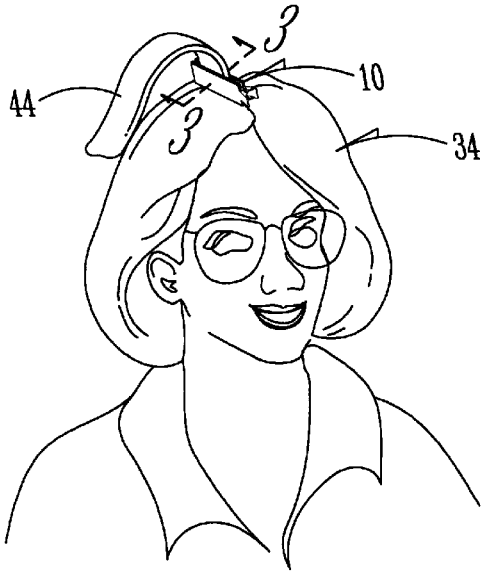
FIG. 1 is a perspective view showing a hair clip according to the present invention attached to a woman's hair.
Figure 4:
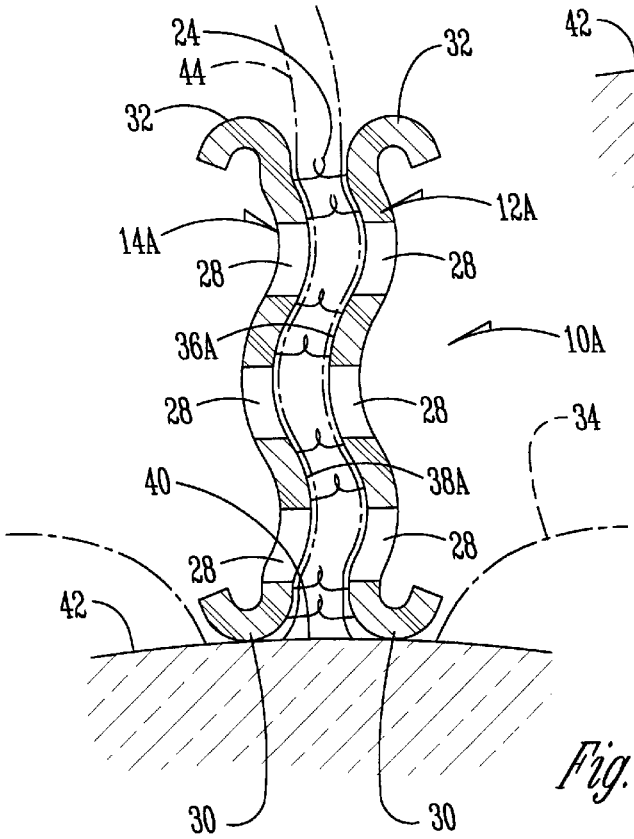
FIG. 4 is a side elevation view of a second embodiment wherein the hair clip has a curved shape.

A cross-sectional view of a second embodiment of a hair clip 10A according to the present invention is shown in FIG. 4. This embodiment is nearly identical to that in FIGS. 1–3. The only difference is that the arms 12A, 14A have a curved shape. The interior faces 36A, 38A are also curve shaped. An curve shaped hair clip 10A helps increase hair volume and texture.

There are a number of different methods in which the clip 10 could be utilized to increase hair volume. For example, the hair clip 10 could be applied to hair 34 and then hair spray could be sprayed on the hair through the grooves 28. The hair clip 10 is applied at the root 40 of the hair 34. The hair clip 10 is left in place until the hair spray is dry. Alternatively, hair spray could be applied to the hair 34, especially on the hair roots 40, and then the clip 10 could be applied and left on until the hair spray is dry. Either way, hair volume is dramatically increased.

The hair clip 10 can also be used in chemical treatment of hair. For example, the hair clip 10 can be used in conjunction with perming, waving, or texturizing solution. The hair 34 is sectioned off, such as is done when giving a perm. A clip 10 is applied to each of the sections of hair. The clip 10 is applied to the root 40 of the hair 34. Conditioner is applied to the part of the hair 44 that sticks out of the clip 10. Conditioner can also be applied to other parts of the hair where solution is not wanted.

Next, the perm solution is applied to the part of the hair 34 that is in the clip 10. The hair 34 is then processed according to the particular perm that is utilized. An alkaline or exothermic perm can be used for extra firmness.

After processing of the hair 34 is complete, the hair 34 is rinsed out with water with the clips 10 still in the hair. Neutralizer is then applied to the hair 34 with the clips 10 still in place. After processing with the neutralizer is done, the clips 10 are removed and the hair is once again rinsed to complete the chemical service. Using the clips 10 in conjunction with perming, waving, or texturizing solution swells the hair shaft and lifts the cuticle enough to add extra volume and texture to the hair.

In the drawings and specification there has been set forth a preferred embodiment of the invention, and although specific terms are employed, these are used in a generic and descriptive sense only and not for purposes of limitation. Changes in the form and proportion of parts as well as in the substitution of the equivalents are contemplated to the circumstances may suggest or render expedient without departing from the spirit or scope of the invention as further defined in the following claims.

What is claimed is:

1. A new method of increasing hair volume, comprising:

providing a hair clip having two arms, each of the arms having an interior face, at least one of the interior faces being textured to apply tension to the hair, and at least one of the arms having openings therethrough to allow a chemical solution to be applied to the hair through the clip; positioning the clip around a section of the hair near the root of the hair so that section of hair is secured between the arms of the clip and positioned generally perpendicular to the scalp;

applying a chemical solution to at least part of the section of hair that is in the clip; and rinsing the hair, after chemical processing is complete, with the clip still in place.

2. The method of claim 1 wherein the chemical solution is perming solution.

3. The method of claim 1 wherein the chemical solution is waving solution.

4. The method of claim 1 wherein the chemical solution is texturizing solution.

5. The method of claim 1, further comprising:

applying neutralizer after rinsing, with the clip still in place.

6. The method of claim 1 wherein hook fibers are on at least on eof the interior faces to supply the texture to the interior face.

7. The method of claim 1 wherein the openings on at least one of the arms are elongated grooves.

8. A new hair clip to increase hair volume, the hair clip comprising:

first and second arms pivotally connected, each arm having an interior face, the first and second arms connected such that their interior faces oppose each other, at least one of the arms having openings to allow rinsing through the clip, and at least one of the interior faces having texture to apply tension to hair roots;

each of the arms having a top portion, a middle portion and a bottom portion, wherein the bottom portion is wider than the middle portion to provide stability so that the arms can be maintained in a direction generally perpendicular to the scalp when applied near the root of the hair.

9. A new method of increasing hair volume, comprising:

applying hair spray to a section of hair near the roots of the hair;

positioning a hair clip around the section of hair so that the section of hair is secured in a position generally perpendicular to the scalp; and leaving the hair clip on the hair root until the hair spray is dry.

10. The method of claim 9 wherein the clip is applied to the hair prior to applying hair spray.

11. The method of claim 9 wherein the hair clip contacts the scalp.

* * * * *